US011109660B2

(12) United States Patent
Lee et al.

(10) Patent No.: US 11,109,660 B2
(45) Date of Patent: Sep. 7, 2021

(54) COSMETIC TOOL

(71) Applicant: AMOREPACIFIC CORPORATION, Seoul (KR)

(72) Inventors: Yoon Hee Lee, Seoul (KR); Jae Sam Byeon, Gyeonggi-do (KR)

(73) Assignee: AMOREPACIFIC CORPORATION, Seoul (KR)

( * ) Notice: Subject to any disclaimer, the term of this patent is extended or adjusted under 35 U.S.C. 154(b) by 0 days.

(21) Appl. No.: 16/634,480

(22) PCT Filed: Aug. 21, 2018

(86) PCT No.: PCT/KR2018/009593
§ 371 (c)(1),
(2) Date: Jan. 27, 2020

(87) PCT Pub. No.: WO2019/045347
PCT Pub. Date: Mar. 7, 2019

(65) Prior Publication Data

US 2020/0154855 A1 May 21, 2020

(30) Foreign Application Priority Data

Aug. 28, 2017 (KR) ..... 10-2017-0108598

(51) Int. Cl.
*A45D 40/20* (2006.01)
*B65D 83/00* (2006.01)

(52) U.S. Cl.
CPC ..... *A45D 40/205* (2013.01); *B65D 83/0005* (2013.01); *A45D 2040/201* (2013.01); *A45D 2040/207* (2013.01)

(58) Field of Classification Search
CPC ..... A45D 40/20; A45D 40/205; A45D 2040/201; A45D 2040/204; A45D 2040/207; B65D 83/0005
See application file for complete search history.

(56) References Cited

U.S. PATENT DOCUMENTS 5,011,317 A * 4/1991 Gueret ..... A45D 40/02 401/66
2012/0076568 A1* 3/2012 Tani ..... A45D 40/262 401/266

(Continued)

FOREIGN PATENT DOCUMENTS

JP 04019198 * 1/1992 ..... A45D 40/20
JP 07231812 * 9/1995 ..... A45D 40/20

(Continued)

*Primary Examiner* — J C Jacyna
(74) *Attorney, Agent, or Firm* — Novick, Kim & Lee, PLLC; Sang Ho Lee; Hyun Woo Shin

(57) ABSTRACT

Provided is a cosmetic tool, including: an external shape part having a core-type cosmetic product accommodated therein, having an exit arranged on one side thereof, and having at least one through-hole; a cover part arranged to be adjacent to the exit, and having an openable or closable structure; a button part arranged on the other side of the external shape part, and having a stopper exposed to the outside through the through-hole; a pressurizing part located inside the external shape part, and arranged to be movable to the exit by pressurizing the button part; an opening and closing part for opening the cover part by pressurizing the button part; a piston part for pushing out the cosmetic product; and a push part having, on one side thereof, a plurality of leg parts that are widened, and pushing the piston part to the exit while the leg parts are widened when moving to the exit by the pressurizing part.

7 Claims, 8 Drawing Sheets

(56) References Cited

U.S. PATENT DOCUMENTS

| | | | | |
|---|---|---|---|---|
| 2015/0230587 | A1* | 8/2015 | Chan | A45D 34/042<br>401/55 |
| 2017/0295907 | A1* | 10/2017 | Yasumi | A45D 40/205 |

FOREIGN PATENT DOCUMENTS

| | | | |
|---|---|---|---|
| JP | 08-258480 | A | 10/1996 |
| JP | 2002-166693 | A | 6/2002 |
| JP | 2010-125602 | A | 6/2010 |
| KR | 10-1204399 | B1 | 11/2012 |
| KR | 10-1597115 | B1 | 3/2016 |

* cited by examiner

COSMETIC TOOL

TECHNICAL FIELD

The present invention relates to a cosmetic tool, and particularly, to a cosmetic tool having an improved mechanism of a button-push operation.

BACKGROUND ART

Generally, among cosmetic tools, a plurality of products having a pencil shape exist. As an example, an eyebrow pencil for eyebrow makeup, an eyeliner for makeup on a perimeter of an eye, and the like have a pencil form including a solid cosmetic product having a rod shape.

Such pencil-form cosmetic tools are generally used due to advantages of being easily gripped by a user and are useful for local makeup. However, while continuously using a pencil including a solid cosmetic product, a user has to continuously shave a peripheral part surrounding the solid cosmetic product in order to expose an end of the cosmetic product which is inconvenient.

Accordingly, recently, cosmetic tools having a mechanical pencil form through which a rod-shaped cosmetic product is automatically withdrawn by a certain length when a button is pushed or turned have been developed. A peripheral part surrounding a rod-shaped cosmetic product of such cosmetic tools does not need to be shaved, and thus convenience may be significantly increased.

However, in a mechanical pencil type product, when an end of a solid cosmetic product is exposed all the time, a problem arises that the product may be contaminated and cause skin trouble. To fix the problem, a product including a cover for an end of a product has been developed.

However, when a user intends to use a cosmetic tool provided to directly separate a cover fitting in a front end thereof, it is uncomfortable and complicated. Accordingly, recently, an improvement has been made in which a cover configured to be automatically opened or closed is provided.

In a product through which a cosmetic product is withdrawn to a certain length by a push of a button and which has a cover that is automatically opened or closed, to maximize user's convenience, research and development for improving an operational structure have been continuously performed.

DISCLOSURE

Technical Problem

The present invention is created to solve the problems of existing technologies. The present invention is directed to providing a cosmetic tool which includes a cover covering a cosmetic product that is opened when a button is pushed so that the cosmetic product is automatically withdrawn to a certain length and which increases user's satisfaction by improving an operational mechanism of pushing of the button.

Technical Solution

One aspect of the present invention provides a cosmetic tool including an exterior portion which accommodates a rod-shaped cosmetic product and has an exit provided in one side and one or more through holes, a cover portion provided to be adjacent to the exit and having an openable or closable structure, a button portion provided on the other side of the exterior portion and including a stopper exposed outward through the through hole, a pressurizing portion located inside the exterior portion and provided to be movable toward the exit by pressurizing of the button portion, an opening or closing portion configured to open the cover portion due to pressurizing of the button portion, a piston portion configured to push the cosmetic product, and a push portion comprising a plurality of spreading leg portions formed on one side and configured so that the leg portions spread open and the piston portion is pushed toward the exit when being moved toward the exit by the pressurizing portion.

The cosmetic tool may further include an interior portion provided on the exit side in comparison to the pressurizing portion inside the exterior portion and a first elastic member provided between the interior portion and the pressurizing portion to push the pressurizing portion in a direction opposite to the exit on the basis of the interior portion.

The cosmetic tool may further include a cylinder portion located inside the interior portion to form a movement path of the cosmetic product. Here, the piston portion may move inside the cylinder portion and push the cosmetic product, and the opening or closing portion may be provided outside the cylinder portion and open the cover portion due to pressurizing of the button portion. The cosmetic tool may further include a second elastic member provided between the cylinder portion and the opening or closing portion to push the opening or closing portion toward the cover portion on the basis of the cylinder portion.

The cosmetic tool may further include a third elastic member provided between the pressurizing portion and the cylinder portion to push the cylinder portion toward the exit on the basis of the pressurizing portion.

The cosmetic tool may further include a ring portion provided on an outer circumference of the push portion to adjust spreading of the leg portions. Here, the ring portion may be engaged with the other side of the cylinder portion and restricted in movement toward the exit. Also, when the push portion moves toward the exit on the basis of the ring portion, the leg portions may spread such that the piston portion may be pushed toward the exit.

The button portion may include a button protruding toward the other side of the exterior portion, an elastic arm having an elastic force that is bending outward from a center of the exterior portion, and one or more such stoppers provided on the elastic arm.

The stoppers may include a first stopper and a second stopper provided in a direction moving away from the exit. Here, the exterior portion may include a first through hole and a second through hole provided in the direction moving away from the exit, and the first through hole may have a length relatively longer than that of the second through hole.

Before the button portion is pressurized, the first stopper may be located in the first through hole and the second stopper may be located in the second through hole. Here, when the button portion is primarily pressurized, the first stopper may move toward one end of the first through hole and the second stopper may be separated from the second through hole and located inside the exterior portion as the elastic arm is bent. When the button portion is secondarily pressurized, the first stopper may move toward the one end of the first through hole and the second stopper may move toward the exit and be located on the other end of the first through hole in the exterior portion. Also, when the button portion is tertiarily pressurized, the first stopper may be located on one end of the first through hole and the second stopper may move toward the one end of the first through hole.

When the button portion is primarily pressurized, the opening or closing portion may move toward the exit and opens the cover portion. Here, when the button portion is secondarily pressurized, the cylinder portion may move toward the exit and expose the cosmetic product through the exit. Also, when the button portion is tertiarily pressurized, as the leg portions spread, the push portion may push the piston portion toward the exit and the piston portion may push the cosmetic product from the cylinder portion toward the exit.

Advantageous Effects

According to the embodiments of the present invention, a cosmetic tool, in which a cover is opened and a cosmetic product is withdrawn by pushing a button, is improved in an operational mechanism including pushing the button to returning the button to an original position for a user's convenience so as to more conveniently apply makeup.

MODES OF THE INVENTION

Figure 1:
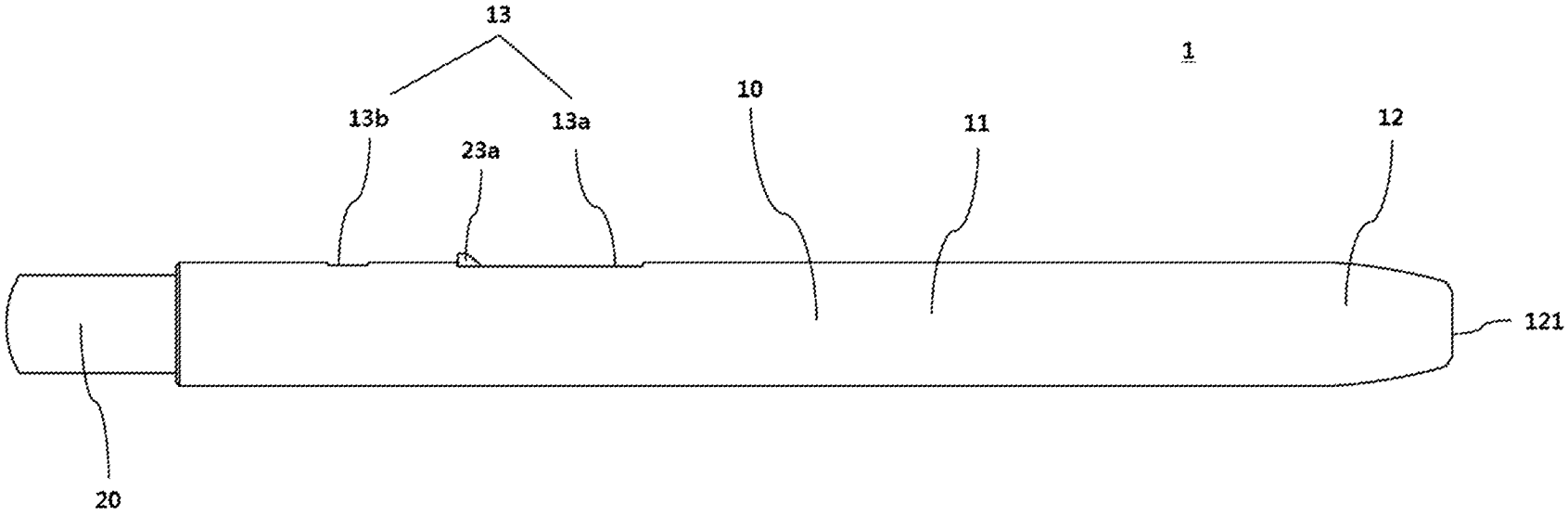
FIG. 1 is a side view of a cosmetic tool according to one embodiment.

The aspects, particular advantages, and novel features of the present invention will become apparent from a following detailed description of exemplary embodiments with reference to the attached drawings. While reference numerals are given to components of each drawing, it should be noted that although shown in different drawings, like components will be referred to as like reference numerals if possible. Also, in a description of the embodiments of the present invention, a detailed description of well-known components or functions of the related art will be omitted when it is deemed to obscure understanding of the embodiments of the present invention.

Hereinafter, an exemplary embodiment of the present invention will be described in detail with reference to the attached drawings. Hereinafter, for convenience, one side or one end may refer to a place close to an exit, and the other side or the other end may refer to a place far from the exit. However, it should be noted that such terms do not directly limit the scope of the present invention.

Figure 2:
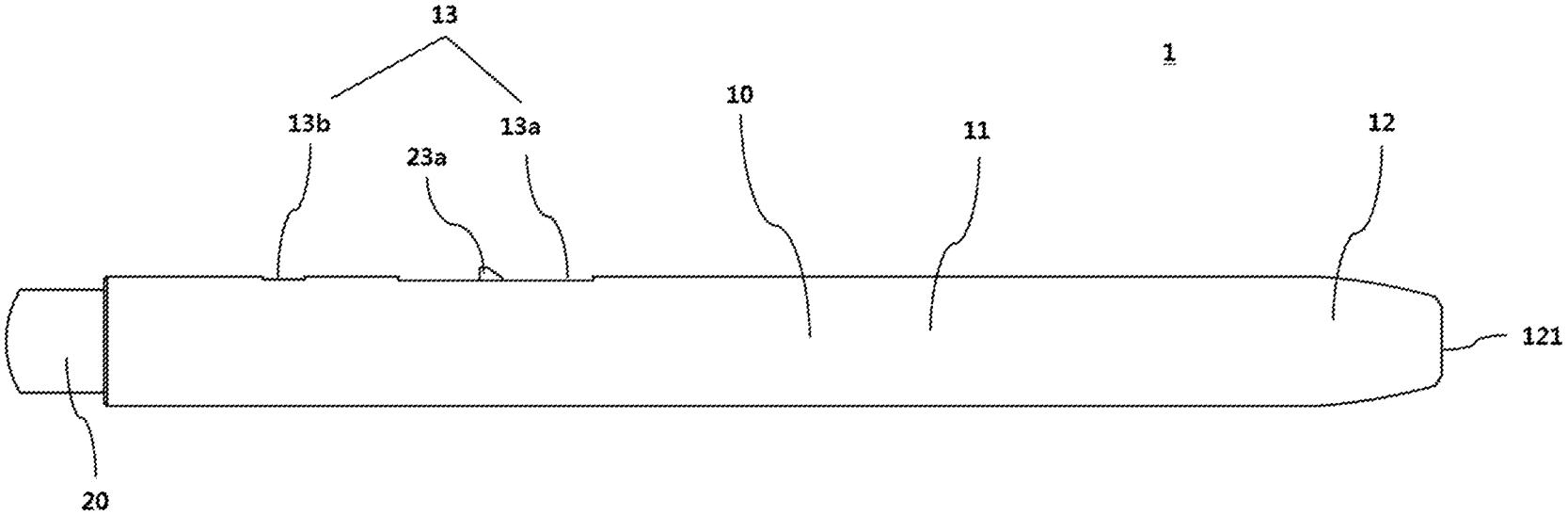
FIG. 2 is a side view of the cosmetic tool according to one embodiment.
Figure 3:
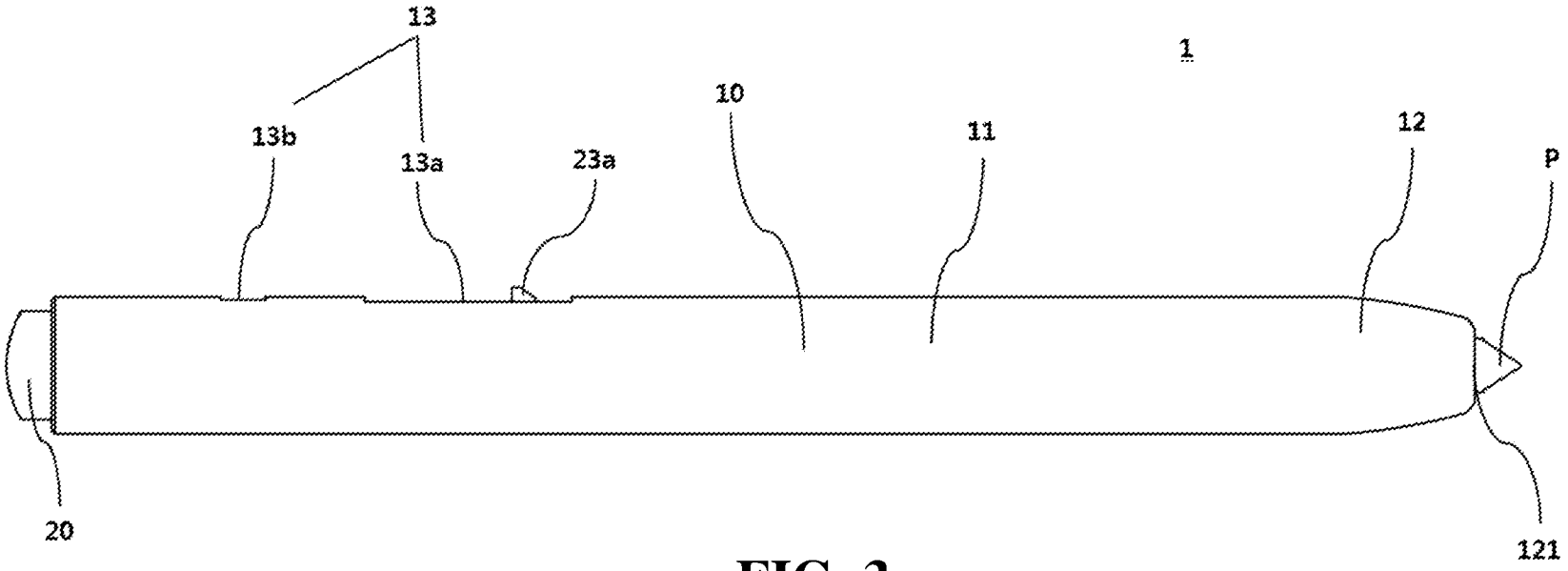
FIG. 3 is a side view of the cosmetic tool according to one embodiment.
Figure 4:
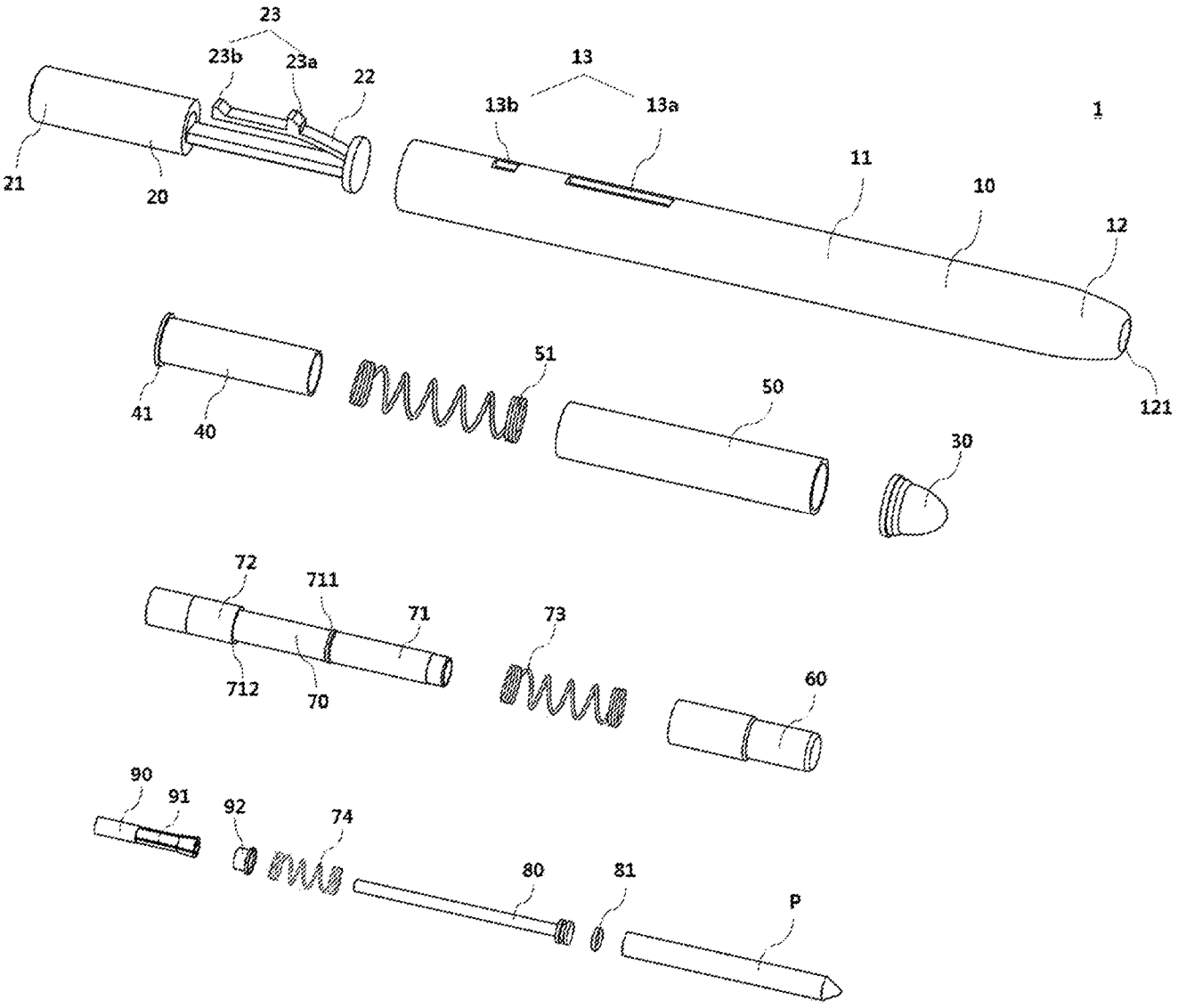
FIG. 4 is an exploded perspective view of the cosmetic tool according to one embodiment.
Figure 5:
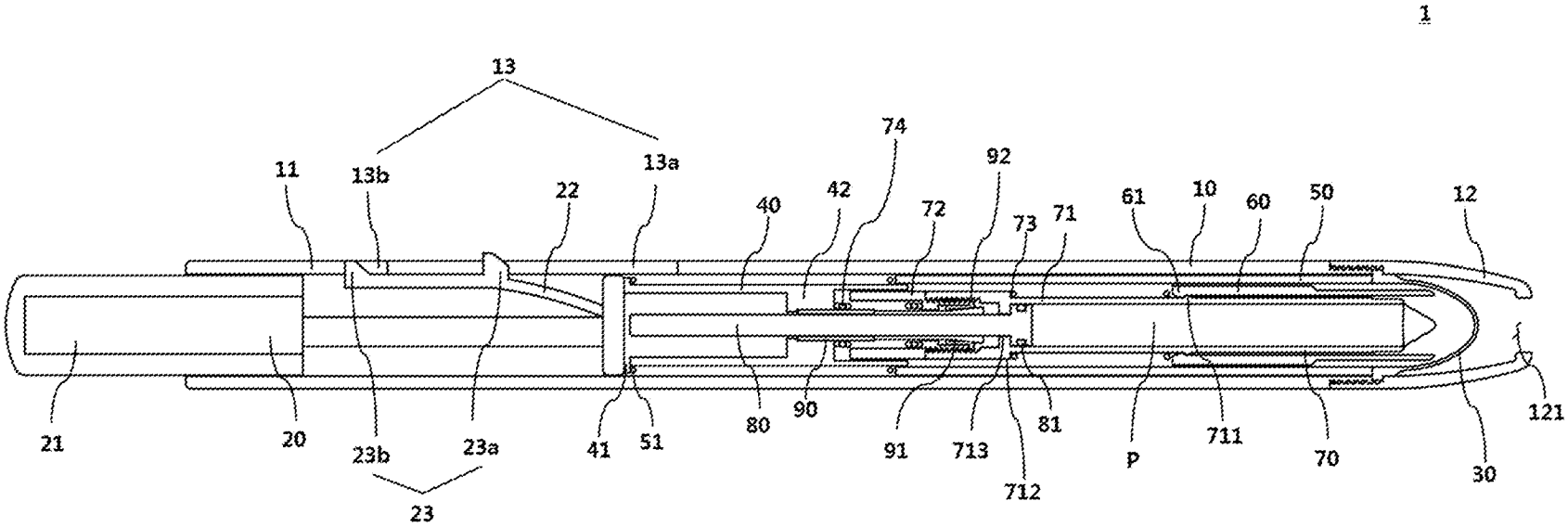
FIG. 5 is a side cross-sectional view of the cosmetic tool of FIG. 1.
Figure 6:
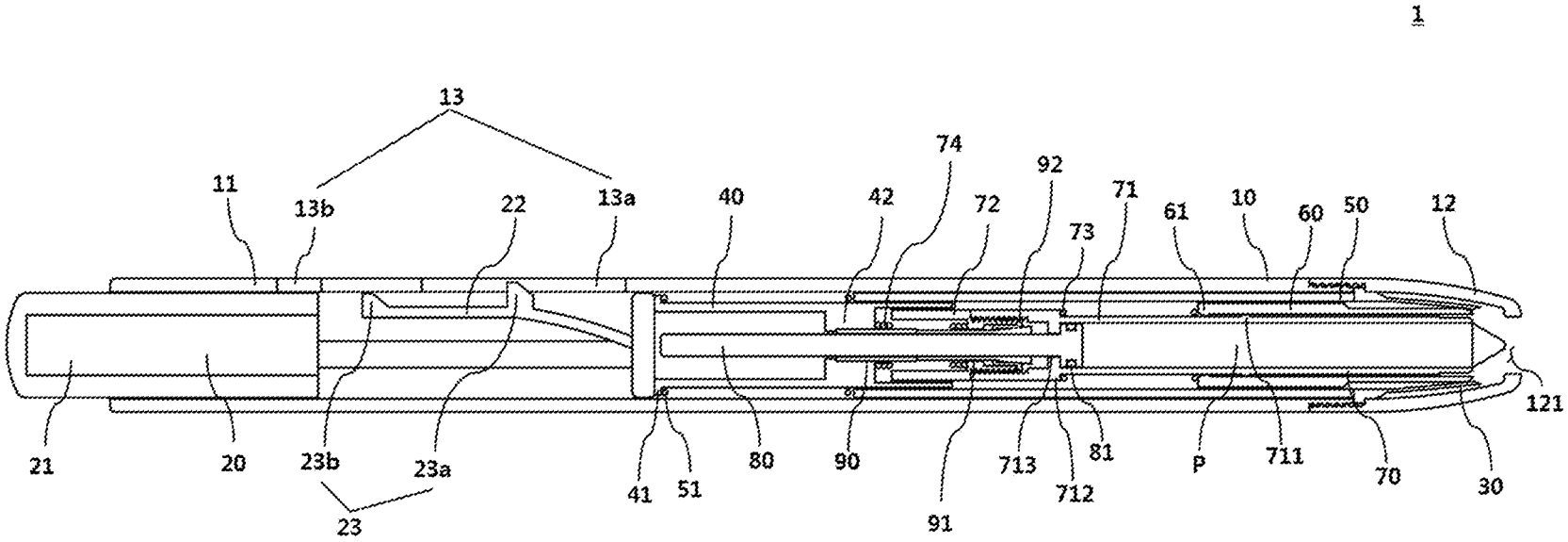
FIG. 6 is a side cross-sectional view of the cosmetic tool of FIG. 2.
Figure 7:
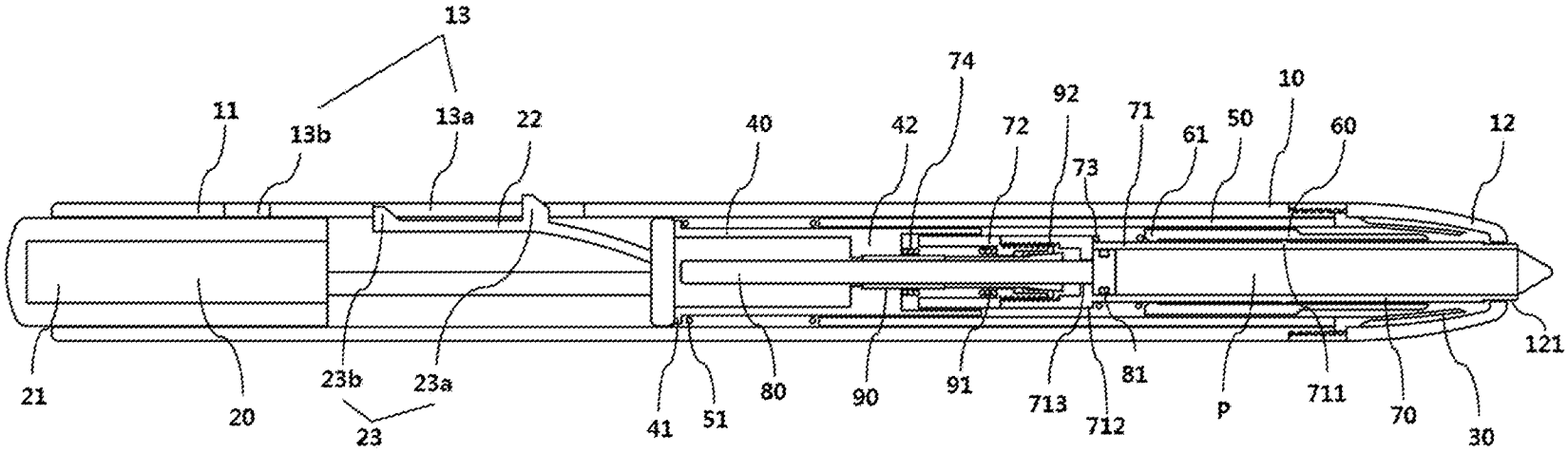
FIG. 7 is a side cross-sectional view of the cosmetic tool of FIG. 3.
Figure 8:
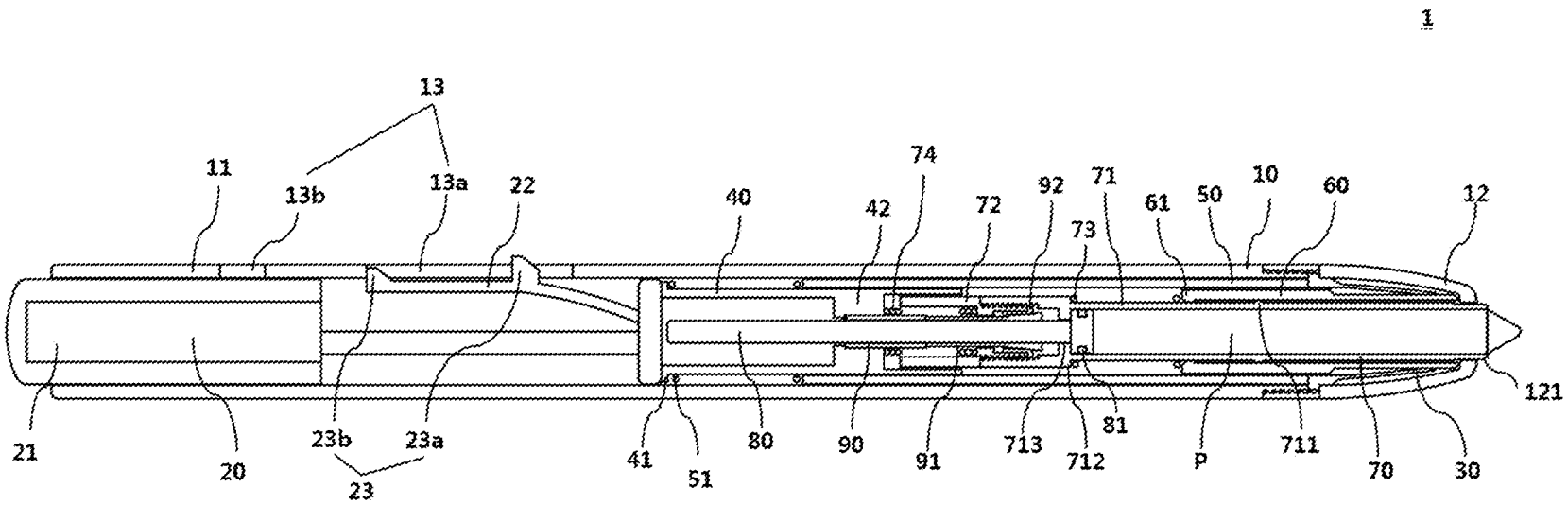
FIG. 8 is a side cross-sectional view of the cosmetic tool of FIG. 3.

FIGS. 1 to 3 are side views of the cosmetic tool according to one embodiment of the present invention. FIG. 4 is an exploded perspective view of the cosmetic tool according to one embodiment of the present invention, FIG. 5 is a side cross-sectional view of the cosmetic tool of FIG. 1, and FIG. 6 is a side cross-sectional view of the cosmetic tool of FIG. 2. FIGS. 7 and 8 are side cross-sectional views of the cosmetic tool of FIG. 3.

For reference, FIGS. 1 and 5 illustrate a state in which a button 21 is not pressurized. FIGS. 2 and 6 illustrate a state in which the button 21 is primarily pressurized. FIGS. 3, 7, and 8 illustrate a state in which the button 21 is secondarily pressurized.

Referring to FIGS. 1 to 8, a cosmetic tool 1 according to one embodiment of the present invention includes an exterior portion 10, a button portion 20, a cover portion 30, a pressurizing portion 40, an interior portion 50, an opening or closing portion 60, a cylinder portion 70, a piston portion 80, and a push portion 90.

The exterior portion 10 accommodates a cosmetic product P having a rod shape and includes an exit 121 provided in one side. The rod-shaped cosmetic product P may be formed of a solid cosmetic product P, but a texture, ingredients, and the like are not particularly limited. Also, a use, function, and the like of the cosmetic product P described in the embodiment are not particularly limited.

The exterior portion 10 may have a tubular shape and may include a grip portion 11 and an exit portion 12. The grip portion 11 is a part gripped by a user with a hand and has a tubular shape having a certain length and including a hollow with opened one and other sides.

The grip portion 11 may include a through hole 13 to expose a stopper 23 of the button portion 20 which will be described below. The through hole 13 may include a first through hole 13*a* and a second through hole 13*b* provided in a direction moving away from the exit 121. Here, the first through hole 13*a* has a relatively longer length than that of the second through hole 13*b*.

The exit portion 12 is provided in one side of the grip portion 11 and includes the exit 121. The grip portion 11 and the exit portion 12 may be provided to be detachably coupled using a screw and the like, and a connection point of the exit portion 12 and the grip portion 11 is not particularly limited.

However, the exterior portion 10 may have a shape having a diameter gradually decreasing toward one side to form the exit 121 in one side, and the connection point of the grip portion 11 and the exit portion 12 may be located in the other side rather than a start point from which the diameter becomes decreased. In this case, the grip portion 11 may have a tubular shape having a constant diameter.

The button portion 20 is provided on the other side of the exterior portion 10. The button portion 20 may be provided on the other side of the exterior portion 10 which is opened and may have a shape protruding outward from the exterior portion 10. The cosmetic product P may be exposed and withdrawn in by a pressure of the button portion 20 which will be described below.

The button portion 20 includes the button 21, an elastic arm 22, and a stopper 23. The button 21 may protrude through the other side of the exterior portion 10. A protruding length may be provided so as to allow the piston portion 80 to lift the cosmetic product P upward due to the push portion 90, which will be described, when the button portion 20 is pressurized.

The elastic arm 22 is provided to extend from one side of the button portion 20 toward the other side and has an elastic force that is bending outward from a center of the exterior portion 10. The elastic arm 22 is provided such that one end of the elastic arm 22 is fixed and the other side thereof is located as a free end and the elastic arm 22 is interfered with by the exterior portion 10 and bent when the button portion 20 moves toward one side by pushing the button 21.

The stopper 23 is provided on the elastic arm 22. The stopper 23 includes a first stopper 23*a* and a second stopper 23*b* provided in a direction moving away from the exit 121. The first stopper 23*a* and the second stopper 23*b* may be provided to be exposed by the through holes 13 corresponding thereto. As an example, the first stopper 23*a* may be located at the first through hole 13*a* and the second stopper 23*b* may be located at the second through hole 13*b*. However, this case is a state in which the button portion 20 is not pressurized. As the button portion 20 is pressurized, a position of the stopper 23 may be changed.

The cover portion 30 is provided to be close to the exit 121 and has an openable or closable structure. The cover portion 30 may be, for example, a diaphragm shape having a cutting line spreading in a cross shape, but the shape of the cover portion 30 is not particularly limited.

The diaphragm provided on the cover portion 30 spreads due to the opening or closing portion 60 such that the cover portion 30 may be opened. On the other hand, when the opening or closing portion 60 recedes from the cover portion 30, the cover portion 30 may return to a sealed state using an elastic force and the like.

The cover portion 30 may be provided inside the exterior portion 10. Accordingly, even when foreign substances flow into the exterior portion 10 through the exit 121, the cosmetic product P may be sanitarily protected by the cover portion 30.

The pressurizing portion 40 is located inside the exterior portion 10 and provided to be movable toward the exit 121 by a pressure applied by the button portion 20. The pressurizing portion 40 has a hollow tubular shape and the other side thereof may be pressurized by the button portion 20. When the pressurizing portion 40 is pressurized by the button portion 20, the pressurizing portion 40 may push the push portion 90 toward one side.

Also, when the pressurizing portion 40 is moved toward the exit 121 by the button portion 20, a first elastic member 51 provided between the pressurizing portion 40 and the interior portion 50 may be compressed. To this end, a step 41 may be formed outside the other side of the pressurizing portion 40 and the first elastic member 51 may be mounted on the step 41.

Also, when the pressurizing portion 40 is moved by the button portion 20, the cylinder portion 70 may be moved toward the exit 121 by a third elastic member 74 provided at the pressurizing portion 40. To this end, an annular rim 42 configured to surround the push portion 90 and having one side which comes into contact with the third elastic member 74 may be provided inside the pressurizing portion 40 and may be disposed between one side and the other side of the pressurizing portion 40.

When the cylinder portion 70 moves toward the exit 121, as the opening or closing portion 60 is moved toward the exit 121 by the cylinder portion 70 (in detail, by a second elastic member 73 provided between the opening or closing portion 60 and the cylinder portion 70) the cover portion 30 may be opened such that the cosmetic product P provided in the cylinder portion 70 may be exposed outward through the exit 121. A series of operation mechanisms as described above will be described below in detail.

The interior portion 50 is provided inside the exterior portion 10 and is provided on the exit 121 side in comparison to the pressurizing portion 40. The interior portion 50 is provided to perform a function of returning the pressurizing portion 40 to an original position when the pressurizing portion 40 is moved toward the exit 121 by the button portion 20 and then the button portion 20 is released from the pressure.

To this end, the first elastic member 51 configured to push the pressurizing portion 40 in a direction opposite the exit 121 on the basis of the interior portion 50 may be provided between the interior portion 50 and the pressurizing portion 40. Here, the interior portion 50 may be a component provided to fix one side of the first elastic member 51 having the other side provided at the step 41 of the pressurizing portion 40.

The interior portion 50 may have a hollow tubular shape, and one side of the interior portion 50 may be engaged with the other side of the exit portion 12 so as to restrict movement toward the exit 121. That is, the interior portion 50 may be in a state in which a position thereof is restricted inside the exterior portion 10.

Otherwise, since the interior portion 50 may be a component which does not need movement inside the exterior portion 10, the interior portion 50 may be provided while being integrated with the exterior portion 10. In this case, a step (not shown) may be formed on an inner wall of the exterior portion 10, and the first elastic member 51 provided between the step of the exterior portion 10 and the step 41 of the pressurizing portion 40 may be compressed by movement of the pressurizing portion 40 and push the pressurizing portion 40 toward the other side.

The opening or closing portion 60 opens the cover portion 30 by a pressure of the button portion 20. When the button portion 20 is pressurized, the opening or closing portion 60 may open the cover portion 30 by pushing the diaphragm forming the cover portion 30 while moving toward the exit 121 so as to allow the diaphragm to spread.

The opening or closing portion 60 may be provided outside the cylinder portion 70 and open the cover portion 30 due to the pressure of the button portion 20. Here, when the cylinder portion 70 moves toward the exit 121, the opening or closing portion 60 may receive an elastic force of the second elastic member 73 provided between the opening or closing portion 60 and the cylinder portion 70 and move toward the exit 121.

A protrusion 61 is provided on an inner wall of the other side of the opening or closing portion 60 and is held by a holding step 711 of the cylinder portion 70 such that a movement range thereof toward the exit 121 may be restricted even when the opening or closing portion 60 receives an elastic force from the second elastic member 73.

However, when the cylinder portion 70 is moved toward the exit 121 by the pressure of the button portion 20, as the opening or closing portion 60 opens the cover portion 30 and then the movement of the opening or closing portion 60 is restricted by the cover portion 30, the protrusion 61 of the opening or closing portion 60 is spaced apart from the holding step 711 of the cylinder portion 70 toward the other side while simultaneously compressing the second elastic member 73.

The cylinder portion 70 is located inside the interior portion 50 and forms a movement path of the cosmetic product P. The cosmetic product P having a rod shape may be accommodated in the cylinder portion 70. When the cylinder portion 70 is moved toward the exit 121 by a first pressure of the button portion 20, the cosmetic product P integrally moves with the cylinder portion 70 while not moving inside the cylinder portion 70. Afterwards, when the button portion 20 is additionally pressurized such that the piston portion 80 moves inside the cylinder portion 70, the cosmetic product P may move from the cylinder portion 70 toward one side.

The cylinder portion 70 may include one side cylinder portion 71 which accommodates the cosmetic product P and the other side cylinder portion 72 provided on the other side of the one side cylinder portion 71. The one side cylinder portion 71 and the other side cylinder portion 72 may be integrated by screw-coupling and the like.

The holding step 711 may be provided at the one side cylinder portion 71 at a position close to the exit 121 than the protrusion 61 of the opening or closing portion 60 so as to restrict the opening or closing portion 60 from moving toward the exit 121.

A step 712 may be provided on the other side of the opening or closing portion 60 in the one side cylinder portion 71, and the other side of the second elastic member 73 may come into contact with the step 712. Accordingly, the second elastic member 73 may be provided between the cylinder portion 70 and the opening or closing portion 60 and push the opening or closing portion 60 toward the cover portion 30 on the basis of the cylinder portion 70 such that the opening or closing portion 60 may open the cover portion 30.

In detail, one side of the second elastic member 73 may come into contact with the opening or closing portion 60 and the other side thereof may come into contact with the step 712 of the one side cylinder portion 71. When the cylinder portion 70 moves, the opening or closing portion 60 may be moved with the cylinder portion 70 toward the exit 121 by an elastic force of the second elastic member 73 while slightly compressing the second elastic member 73.

A hole 713 for inserting the piston portion 80 thereinto may be formed near a part of the one side cylinder portion 71 on which the step 712 is provided, and the piston portion 80 may be provided to be movable through the hole 713 on the basis of the one side cylinder portion 71.

A ring portion 92 may be mounted on an inner wall of the other side of the one side cylinder portion 71, and the inner wall of the other side of the one side cylinder portion 71 may have a step-shaped cross section. The ring portion 92 may come into contact with a part inside the other side of the one side cylinder portion 71 which has a relatively greater diameter, and a movement path of the push portion 90 may be formed on a part inside the other side thereof which has a relatively smaller diameter.

That is, through an inner wall structure of the one side cylinder portion 71, the push portion 90 may be provided to move toward the exit 121 on the basis of the ring portion 92 such that the piston portion 80 may move in the cylinder portion 70 due to the movement of the push portion 90.

One end of the one side cylinder portion 71 may have a diameter smaller than or equal to that of the exit 121, and the one side cylinder portion 71 may have a diameter greater than that of the exit 121 at one point from the one end toward the other side. Accordingly, when the cylinder portion 70 is pressurized by the button portion 20 and moved toward the exit 121, the one end of the one side cylinder portion 71 passes through the exit 121 while the cosmetic product P is accommodated so as to adequately expose the cosmetic product P outward. Here, the one point is held by the exit 121 so as to restrict further movement.

The other side cylinder portion 72 may be provided to be detachable from the one side cylinder portion 71 and may include the third elastic member 74 between the other side cylinder portion 72 and the pressurizing portion 40. The third elastic member 74 may be provided between the pressurizing portion 40 and the cylinder portion 70 and may push the cylinder portion 70 toward the exit 121 on the basis of the pressurizing portion 40. That is, the cylinder portion 70 may be moved by the third elastic member 74 instead of being directly pressurized by the pressurizing portion 40.

However, when the cylinder portion 70 exposes the cosmetic product P through the exit 121 and then the button portion 20 is additionally pressurized, the third elastic member 74 may be compressed while the pressurizing portion 40 pushes the push portion 90 such that the push portion 90 pushes the piston portion 80 which will be described below.

The piston portion 80 pushes the cosmetic product P. The piston portion 80 may push the cosmetic product P while moving inside the cylinder portion 70. The piston portion 80 that has moved toward one side toward the exit 121 may not return toward the other side in the cylinder portion 70. To this end, an O-ring 81 may be provided in the piston portion 80 and be pressurized against an inner wall of the cylinder portion 70 so as to restrict unnecessary movement of the piston portion 80.

The piston portion 80 may have a supine-T shape provided passing through the hole 713 of the one side cylinder portion 71, and the other side of the piston portion 80 may be pressurized by the pressurizing portion 40. Accordingly, when the button portion 20 pushes the pressurizing portion 40, the pressurizing portion 40 may push the piston portion 80 toward the exit 121.

However, when the pressurizing portion 40 pushes the piston portion 80 while the button portion 20 is primarily pressurized, the cylinder portion 70 also moves toward the exit 121. A position of the piston portion 80 in the cylinder portion 70 may not be changed.

On the other hand, when the button portion 20 is additionally pressurized and the push portion 90 moves toward one side on the basis of the ring portion 92, a leg portion 91 of the push portion 90 spreads so as to naturally push the piston portion 80 toward one side. In this case, the piston portion 80 may gradually move toward one side in the cylinder portion 70 and withdraw the cosmetic product P.

The push portion 90 has a plurality of spreading legs on one side. When the push portion 90 is moved toward the exit 121 by the pressurizing portion 40, the leg portion 91 spreads and pushes the piston portion 80 toward the exit 121. However, the ring portion 92 configured to control spreading of the leg portion 91 is provided on a perimeter of the push portion 90. The ring portion 92 has a step-shaped cross section and is engaged with an inner wall of the other side of the one side cylinder portion 71 so as to be restricted in movement toward the exit 121.

When the button portion 20 is not pressurized, the ring portion 92 may stay in a state that does not allow the leg portion 91 of the push portion 90 to spread. Here, even when the button portion 20 is primarily pressurized, the cylinder portion 70 moves toward the exit 121 such that the ring portion 92 and the push portion 90 move together toward the exit 121. Accordingly, the leg portion 91 may remain in a state that does not spread due to the ring portion 92.

However, when the button portion 20 is additionally pressurized after withdrawal of the cosmetic product P, since the cylinder portion 70 is held by the exit 121 and does not move further as described above, the push portion 90 is moved by the pressurizing portion 40 while the ring portion 92 does not move. Accordingly, the push portion 90 moves toward the exit 121 side on the basis of the ring portion 92 such that the leg portion 91 may be detached from the ring portion 92 and spread. To this end, the leg portion 91 may have an elastic force to spread.

When the push portion 90 moves toward one side and the leg portion 91 spreads, the piston portion 80 gripped by the leg portion 91 may be naturally pushed toward one side. Accordingly, since the piston portion 80 pushes the cosmetic product P due to the push portion 90, withdrawal of the cosmetic product P is performed.

Hereinafter, an operation mechanism of the embodiment will be described below with reference to FIGS. 5 to 8.

As shown in FIG. 5, before the button portion 20 is pressurized, the first stopper 23*a* is located in the first through hole 13*a* and the second stopper 23*b* is located in the second through hole 13*b*. Also, in this case, the opening or closing portion 60, which may have a shape such as a diaphragm and the like, may have a closed shape to isolate the cosmetic product P from the outside.

Afterwards, as shown in FIG. 6, when the button portion 20 is primarily pressurized, the first stopper 23*a* moves toward one end of the first through hole 13*a* and the second stopper 23*b* deviates from the second through hole 13*b* and is located inside the exterior portion 10 as the elastic arm 22 is bent.

Here, the pressurizing portion 40 is moved toward one side by the button portion 20, the first elastic member 51 is compressed as the pressurizing portion 40 moves, the cylinder portion 70 is moved toward one side by the third elastic member 74, and the opening or closing portion 60, which comes into contact with the cylinder portion 70, is moved toward the exit 121 by the second elastic member 73 and opens the cover portion 30.

In this case, since the ring portion 92 maintains a state, in which the leg portion 91 of the push portion 90 does not spread, and is moved with the push portion 90 toward the one side by the pressurizing portion 40, movement of the piston portion 80 due to the push portion 90 is not performed. Accordingly, the cosmetic product P remains in a state of being still in the cylinder portion 70.

Afterwards, as shown in FIG. 7, when the button portion 20 is secondarily pressurized, the first stopper 23*a* further moves toward one end of the first through hole 13*a* and the second stopper 23*b* moves toward the exit 121 and then is held by the other end of the first through hole 13*a* in the exterior portion 10.

Here, due to secondary pressurizing of the button portion 20, the first elastic member 51 is further compressed, the cylinder portion 70 is still moved toward the exit 121 by the third elastic member 74, and one side of the cylinder portion 70 passes through the exit 121 and exposes the cosmetic product P through the exit 121. However, since the opening or closing portion 60 is held by the opened cover portion 30 and is slightly restricted in movement, the second elastic member 73 between the opening or closing portion 60 and the cylinder portion 70 may be compressed.

Afterwards, as shown in FIG. 8, as the second elastic member 73 applies an elastic force to the opening or closing portion 60, the opening or closing portion 60 moves in a direction to open the cover portion 30 such that the cover portion 30 becomes a maximally opened state. Afterwards, although not shown in the drawings, when the button portion 20 is tertiarily pressurized, the first stopper 23*a* is located at one end of the first through hole 13*a* and the second stopper 23*b* moves toward one end of the first through hole 13*a*.

Here, since one end of the cylinder portion 70 is held by the exit 121 and movement thereof is restricted, even when the pressurizing portion 40 is moved by the button portion 20, movement of the cylinder portion 70 may not be performed and the third elastic member 74 may be compressed instead thereof.

However, the push portion 90 moves toward one side due to movement of the pressurizing portion 40. Here, since movement of the cylinder portion 70 is restricted, movement of the ring portion 92 is also restricted. Accordingly, as the push portion 90 moves toward one side on the basis of the ring portion 92, the leg portion 91 of the push portion 90 may spread.

In this case, the push portion 90 may push the piston portion 80 gripped by the leg portion 91 toward the exit 121 using movement and a spreading operation of the leg portion 91, and the piston portion 80 may push the cosmetic product P from the cylinder portion 70 toward the exit 121 side.

When a user releases the tertiary pressurizing of the button portion 20, the second stopper 23*b* returns to a state of FIG. 8 in which the second stopper 23*b* is held by the other end of the first through hole 13*a*. In this state, when the user pressurizes the button portion 20 again, as described above, as the piston portion 80 is pushed by the push portion 90, withdrawal of the cosmetic product P may be performed again.

Accordingly, the tertiary pressurizing of the button portion 20 may be repetitively performed several times, and the cosmetic product P may be withdrawn to an adequate length necessary for the user by the tertiary pressurizing of the button portion 20 which is performed one or more times.

When the user would like to stop using the cosmetic product P, the user may allow the first stopper 23*a* to deviate from the first through hole 13*a* by pushing the first stopper 23*a* toward an inside of the exterior portion 10. In this case, the button portion 20 may return to a state shown in FIG. 5 due to the pressurizing portion 40 which receives an elastic force toward the other side due to the first elastic member 51.

Also, as the push portion 90 capable of being coupled with the pressurizing portion 40 moves with the pressurizing portion 40 toward the other side, the ring portion 92 is held by the push portion 90 and moves toward the other side and the other side cylinder portion 72 having one end held by the ring portion 92 moves with the one side cylinder portion 71 toward the other side. Here, the holding step 711 provided at the one side cylinder portion 71 is engaged with the protrusion 61 of the opening or closing portion 60 and moves the opening or closing portion 60 toward the other side. Accordingly, the cover portion 30 may return to the closed state due to the movement of the opening or closing portion 60 and a restoring force of the cover portion 30.

However, since the cosmetic product P may be continuously withdrawn by the tertiary pressurizing of the button portion 20, when the first stopper 23*a* is pushed while the cosmetic product P is excessively withdrawn, the cosmetic product P withdrawn lengthwise is held such that the cover portion 30 may not be closed. To prevent this, instructions and the like may be written on the exterior portion 10.

As described above, in the embodiment, an operation mechanism of exposing and withdrawing the cosmetic product P through the primary to tertiary pressurizing of the button portion 20 is implemented such that the user may simply withdraw the cosmetic product P even with one hand so as to maximize convenience and increasing a satisfaction level.

Although the exemplary embodiments of the present invention have been described above, these are merely for describing the present invention in detail and the present invention is not limited thereto. Also, it is apparent that a variety of modifications and improvements thereof may be made by one of ordinary skill in the art without departing from the technical concept of the present invention.

All simple modifications and changes of the present invention are included within the scope of the present invention, and a detailed scope of the present invention will be defined by the following claims.

The invention claimed is:

1. A cosmetic tool comprising:

an exterior portion which accommodates a rod-shaped cosmetic product and has an exit provided in one side thereof and at least one through hole;

a cover portion provided to be adjacent to the exit and having an openable or closable structure;

a button portion provided on an other side of the exterior portion and including a stopper exposed outward through the at least one through hole;

a pressurizing portion located inside the exterior portion and provided to be movable toward the exit by pressurizing of the button portion;

an opening or closing portion configured to open the cover portion due to pressurizing of the button portion;

a piston portion configured to push the cosmetic product;

a push portion comprising a plurality of leg portions formed on one side and configured so that the plurality of leg portions spread open and the piston portion is pushed toward the exit when being moved toward the exit by the pressurizing portion;

an interior portion provided on the exit side in comparison to the pressurizing portion inside the exterior portion;

a first elastic member provided between the interior portion and the pressurizing portion to push the pressurizing portion in a direction opposite to the exit on the basis of the interior portion; and a cylinder portion located inside the interior portion to form a movement path of the cosmetic product, wherein the piston portion moves inside the cylinder portion and pushes the cosmetic product, wherein the opening or closing portion is provided outside the cylinder portion and opens the cover portion due to pressurizing of the button portion, and wherein the cosmetic tool further comprises a second elastic member provided between the cylinder portion and the opening or closing portion to push the opening or closing portion toward the cover portion on the basis of the cylinder portion.

2. The cosmetic tool of claim 1, further comprising a third elastic member provided between the pressurizing portion and the cylinder portion to push the cylinder portion toward the exit on the basis of the pressurizing portion.

3. The cosmetic tool of claim 1, further comprising a ring portion provided on an outer circumference of the push portion to adjust spreading of the plurality of leg portions, wherein the ring portion is engaged with an other side of the cylinder portion and restricted in movement toward the exit, and wherein when the push portion moves toward the exit on the basis of the ring portion, the plurality of leg portions spread such that the piston portion is pushed toward the exit.

4. The cosmetic tool of claim 1, wherein the button portion comprises:

a button protruding toward the other side of the exterior portion;

an elastic arm having an elastic force that is bending outward from a center of the exterior portion; and one or more stoppers provided on the elastic arm.

5. The cosmetic tool of claim 4, wherein the stoppers comprise a first stopper and a second stopper provided in a direction moving away from the exit, wherein the exterior portion comprises a first through hole and a second through hole provided in the direction moving away from the exit, and wherein the first through hole has a length relatively longer than that of the second through hole.

6. The cosmetic tool of claim 5, wherein before the button portion is pressurized, the first stopper is located in the first through hole and the second stopper is located in the second through hole, wherein when the button portion is primarily pressurized, the first stopper moves toward one end of the first through hole and the second stopper is separated from the second through hole and located inside the exterior portion as the elastic arm is bent, wherein when the button portion is secondarily pressurized, the first stopper moves toward the one end of the first through hole and the second stopper moves toward the exit and is located on an other end of the first through hole in the exterior portion, and wherein when the button portion is tertiarily pressurized, the first stopper is located on the one end of the first through hole and the second stopper moves toward the one end of the first through hole.

7. The cosmetic tool of claim 6, wherein when the button portion is primarily pressurized, the opening or closing portion moves toward the exit and opens the cover portion, wherein when the button portion is secondarily pressurized, the cylinder portion moves toward the exit and exposes the cosmetic product through the exit, and wherein when the button portion is tertiarily pressurized, as the plurality of leg portions spread, the push portion pushes the piston portion toward the exit and the piston portion pushes the cosmetic product from the cylinder portion toward the exit.

* * * * *